US010440987B2

(12) United States Patent
Zeng et al.

(10) Patent No.: US 10,440,987 B2
(45) Date of Patent: Oct. 15, 2019

(54) DEVICE FOR AUTOMATICALLY DETRUDING CIGARETTE BUTT

(71) Applicant: CHINA TOBACCO YUNNAN INDUSTRIAL CO., LTD, Kunming (CN)

(72) Inventors: Xu Zeng, Kunming (CN); Jianguo Tang, Kunming (CN); Xudong Zheng, Kunming (CN); Ru Wang, Kunming (CN); Chengya Wang, Kunming (CN); Ping Lei, Kunming (CN); Shanzhai Shang, Kunming (CN); Zhiqiang Li, Kunming (CN); Jingmei Han, Kunming (CN); Shunliang Tang, Kunming (CN); Dalin Yuan, Kunming (CN); Yongkuan Chen, Kunming (CN)

(73) Assignee: CHINA TOBACCO YUNNAN INDUSTRIAL CO., LTD, Kunming (CN)

( * ) Notice: Subject to any disclaimer, the term of this patent is extended or adjusted under 35 U.S.C. 154(b) by 0 days.

(21) Appl. No.: 16/322,113

(22) PCT Filed: Aug. 29, 2017

(86) PCT No.: PCT/CN2017/099531
§ 371 (c)(1),
(2) Date: Jan. 31, 2019

(87) PCT Pub. No.: WO2018/041107
PCT Pub. Date: Mar. 8, 2018

(65) Prior Publication Data

US 2019/0183170 A1 Jun. 20, 2019

(30) Foreign Application Priority Data

Aug. 30, 2016 (CN) ..... 2016 1 0773268

(51) Int. Cl.
*A24F 13/00* (2006.01)
*A24F 13/08* (2006.01)
*A24F 7/00* (2006.01)

(52) U.S. Cl.
CPC ..... *A24F 13/08* (2013.01); *A24F 7/00* (2013.01)

(58) Field of Classification Search
CPC ..... A24F 13/02; A24F 13/08; A24F 13/10; A24F 13/22
See application file for complete search history.

(56) References Cited

U.S. PATENT DOCUMENTS 2,534,799 A * 12/1950 Schwinn ..... A24F 13/04 131/182
2,712,316 A * 7/1955 Silverman ..... A24F 13/10 131/182
3,805,808 A * 4/1974 Yoshinaga ..... A24F 13/06 131/182

FOREIGN PATENT DOCUMENTS

CN 2521919 Y 11/2002
CN 2568002 Y 8/2003
(Continued)

*Primary Examiner* — Eric Yaary
(74) *Attorney, Agent, or Firm* — Gokalp Bayramoglu

(57) ABSTRACT

A device for automatically detruding a cigarette butt includes a cigarette clamp, a cigarette fixer, a support ring, a cigarette butt detruding sliding ring, an air outlet end housing, a metal gasket, and a spring. After the cigarette is burnt and smoked, the cigarette butts can be detruded without the necessity of contacting the cigarette butts by hands in a low-resistance state.

5 Claims, 4 Drawing Sheets

(56) References Cited

FOREIGN PATENT DOCUMENTS

| | | | |
|---|---|---|---|
| CN | 201577531 | U | 9/2010 |
| CN | 205214196 | U | 5/2016 |
| CN | 106174699 | A | 12/2016 |
| DE | 3413618 | A1 | 10/1985 |
| GB | 2511302 | A | 9/2014 |

* cited by examiner

DEVICE FOR AUTOMATICALLY DETRUDING CIGARETTE BUTT

CROSS REFERENCE TO RELATED APPLICATIONS

This application is the national phase entry of International Application No. PCT/CN2017/099531, filed on Aug. 29, 2017, which is based upon and claims priority to Chinese Patent Application No. 201610773268.8, filed on Aug. 30, 2016, the entire contents of which are incorporated herein by reference.

TECHNICAL FIELD

The present invention pertains to the field of functional cigarette holders and electronic cigarettes, and in particular relates to a device for automatically detruding a cigarette butt.

BACKGROUND

Smoking, while holding the cigarette between fingers, causes the tobacco odor to linger on the fingers. For a smoker smoking for a long time, the fingers used for holding the cigarette will even be stained by the smoke. When smokers use the tobacco pipe, the cigarette holder, etc. to smoke the traditional cigarettes, the cigarette butts left after the cigarettes are burnt and smoked need to be manually detruded, which is not only laborious, but also ungraceful. There is also a risk of scalding the fingers by cigarette butts. Besides, since the traditional cigarettes have filter tips, it is needless to simply add a tobacco pipe or a cigarette holder in a functional view, when smoking traditional cigarettes.

It is desirable to use a device similar to a tobacco pipe or a cigarette holder for smoking, which can prevent the fingers from directly contacting the cigarette, and detrude the cigarette butt quickly, easily and smoothly. Also, the article like the tobacco pipe or cigarette holder is capable of having other functions, which enables consumers to enjoy more and have more satisfying experiences. Thus, the multi-function cigarette holders and smart cigarette holders are produced.

SUMMARY

Based on the deficiencies of the existing devices in the cigarette butt detruding technology, the objective of the present invention is to provide a device for automatically detruding the cigarette butt. The device enables the cigarette butt to detrude quickly, easily and smoothly.

The objective of the present invention is achieved by the following solution:

A device for automatically detruding a cigarette butt, includes the following components:

a cigarette clamp 1, wherein an overall structure of the cigarette clamp is cylindrical in shape with two open ends; a plurality of positioning protrusion blocks 10 are provided on a cylinder wall of the cigarette clamp; at least two cigarette clamping sheet bases 25 are provided on the cylinder wall of the cigarette clamp; each of the cigarette clamping sheet bases 25 is an inter-slot cylinder wall formed by opening two U-shaped slots 27 in an axial direction from an end portion on the cylinder wall; a cigarette clamping sheet 8 extending in an inward radial direction is provided on an end portion of each of the cigarette clamping sheet bases 25; an elastic sheet 9 extending in the axial direction is provided on the cigarette clamping sheet 8; a space is disposed in the inward radial direction on the elastic sheet 9 to expose the end portion of the cylinder wall on the each cigarette clamping sheet base 25;

a cigarette fixer 2, wherein an overall structure of the cigarette fixer is cup-shaped; an inner diameter of the cigarette fixer gradually increases from bottom to top; a circular connection hole 14 and an arc-shaped airflow channel 16 are provided on the bottom of the cigarette fixer, wherein a plurality of positioning arc-shaped convex points 15 are arranged on an inner peripheral wall of the circular connection hole 14; at least two first sliding grooves 12 penetrating through a wall of the cigarette fixer are provided thereon; a trapezoid platform 13 with a sloped surface extending toward the bottom of the cigarette fixer is provided on an opening end of each first sliding groove 12;

a support ring 3, wherein an overall structure of the support ring is cylindrical in shape with two open ends; a groove 17 is provided on an inner wall of one end of the support ring; a flange 26 is provided on an outer wall of the other end of the support ring; at least two second sliding grooves 19 penetrating through a cylinder wall of the support ring are provided thereon;

a cigarette butt detruding sliding ring 4, wherein an overall structure of the cigarette butt detruding sliding ring is cylindrical in shape with two open ends, and an annular groove 20 and a positioning groove 11 are provided on an inner wall of one end of the cigarette butt detruding sliding ring; a shape of the positioning groove 11 is matched with a shape of the positioning protrusion block 10 on the cigarette clamp 1;

an air outlet end housing 5, wherein an overall structure of the air outlet end housing is in a hollow duckbill-shaped cylinder-like shape; a first boss 18 is provided on an end surface of one end of the air outlet end housing; an arc-shaped airflow through hole 21 and a second boss 22 are provided on the end surface of the first boss 18; a plurality of positioning arc-shaped concave points 23 are provided on a peripheral wall of the second boss 22; a number and a shape of the positioning arc-shaped concave points 23 are matched with a number and a shape of the positioning arc-shaped convex points 15 on the cigarette fixer 2;

a metal gasket 6, an overall structure thereof is a notched annular elastic member; and a spring 7.

The positional relationship of the above-mentioned components is as follows:

The circular connection hole 14 at the bottom of the cigarette fixer 2 is sleeved on the second boss 22 of the air outlet end housing 5. The circular connection hole 14 and the second boss 22 are connected to each other through a cooperation of the positioning arc-shaped convex point 15 with the positioning arc-shaped concave point 23. The arc-shaped airflow channel 16 and the arc-shaped airflow through hole 21 butt each other after realizing the connection between the circular connection hole 14 and the second boss 22.

The support ring 3 is sleeved on an outer periphery of the cigarette fixer 2. The second sliding groove 19 coincides with the first sliding groove 12. The groove 17 of the support ring 3 is sleeved on an outer periphery of the first boss 18 of the air outlet end housing 5.

The cigarette clamp 1 is sleeved on an outer periphery of the support ring 3. The cigarette clamping sheet base 25, the cigarette clamping sheet 8 and the elastic sheet 9 are located inside the second sliding groove 19 and the first sliding groove 12. The elastic sheet 9 and the trapezoid platform 13 with the sloped surface of the cigarette fixer 2 are in the same straight line.

The cigarette butt detruding sliding ring 4 is sleeved on an outer periphery of the metal gasket 6 and an outer periphery of the flange 26 of the support ring 3. The cigarette butt detruding sliding ring 4 is connected to the metal gasket 6 through clamping and sleeving the annular groove 20 of the inner wall of one end of the cigarette butt detruding sliding ring 4 on the outer periphery of the metal gasket 6 in a pre-stressed state. The cigarette butt detruding sliding ring 4 is connected to the flange 26 of the support ring 3 through sleeving the inner wall of the other end of the cigarette butt detruding sliding ring 4 on the outer periphery of the flange 26 of the support ring 3. The positioning groove 11 matches the positioning protrusion block 10.

The spring 7 is sleeved on an outer periphery of a cylindrical section of the support ring 3. One end of the spring 7 abuts against the end portion of the cylinder wall of the cigarette clamp 1 and is sleeved on an outer periphery of the elastic sheet 9. The other end of the spring 7 abuts against the flange 26 of the support ring 3.

The metal gasket 6 contacts an end portion of the cylinder wall of the cigarette clamp 1 away from the elastic sheet 9 in the axial direction.

Preferably, an outer diameter of the cigarette fixer is constant, but a wall thickness of the cigarette fixer gradually decreases from bottom to top, thereby achieving an increase of the inner diameter of the cigarette fixer 2 from bottom to top.

A side facet of the cigarette clamping sheet 8 on the cigarette clamp 1 is in contact with a side facet of the first sliding groove 12 on the cigarette fixer 2 and a side facet of the second sliding groove 19 on the support ring 3 when rotating, so as to transmit torque.

The cigarette clamp 1, the cigarette fixer 2 and the support ring 3 are all made of elastic materials. The elastic materials may be rubber or plastic.

The device for automatically detruding the cigarette butt and the parts thereof according to the present invention will be separately described hereinafter with reference to the drawings.

The cigarette clamp 1 is preferably made of plastic having a certain elasticity. As shown in FIG. 6, an overall structure of the cigarette clamp 1 is cylindrical in shape with two open ends. Two cigarette clamping sheets 8 extending in an inward radial direction are provided on an end of the cigarette clamp 1. Two elastic sheets 9 in the axial direction are provided on front ends of the two cigarette clamping sheets 8 to open the two cigarette clamping sheets 8 and relieve the clamping of the two cigarette clamping sheets 8 to the cigarette butt. Four positioning protrusion blocks 10 extending in a radial direction along an exterior of the device are provided on the other end of the cigarette clamp 1. The four positioning protrusion blocks 10 are embedded in the four positioning grooves 11 of an inner wall of the cigarette butt detruding sliding ring 4 (see FIG. 8). When the cigarette butt detruding sliding ring 4 is rotated, the inner side peripheries of the four positioning grooves 11 of the inner wall of the cigarette butt detruding sliding ring 4 transmit torque to the cigarette clamp 1 through the four positioning protrusion blocks 10 of the cigarette clamp 1. The cigarette clamp 1 transmits the torque to a side facet of the first sliding groove 12 on the cigarette fixer 2 and a side facet of the second sliding groove 19 on the support ring 3 through a side facet of the cigarette clamping sheet 8 (the cigarette clamping sheet 8 radially passes through the first sliding groove 12 of the cigarette fixer 2 and the second sliding groove 19 of the support ring 3). Thus, when the cigarette butt detruding sliding ring 4 rotates in a peripheral direction, the cigarette clamp 1, the cigarette fixer 2, and the support ring 3 are synchronously driven to rotate in the peripheral direction. When the cigarette butt detruding sliding ring 4 moves axially, the cigarette clamp 1 is driven to move axially synchronously through a torque transmission of the metal gasket 6 and the four positioning protrusion blocks 10 of the cigarette clamp 1. When the cigarette butt detruding sliding ring 4 is automatically reset by the spring and returns to the initial position, the cigarette clamp 1 is driven to be automatically reset by the torque transmitted through the four positioning protrusion blocks of the cigarette clamp 1 and the elastic force of the spring. When the cigarette clamp 1 is reset (i.e., when the cigarette clamp 1 is in the initial position of the device in the natural state or the traditional cigarette 24 is inserted into the initial natural state, see FIG. 9), due to an outward supporting action of an outer surface of one end of the second sliding groove 19 on the support ring 3, the cigarette clamp 1 is in a pre-stressed state, namely, a relaxed state.

As shown in FIG. 5, the cigarette fixer 2 is preferably made of plastic having a certain elasticity. An overall external structure of the cigarette fixer 2 is cylindrical in shape. The cigarette fixer 2 is provided with two first sliding grooves 12. The cigarette clamping sheet 8 on the cigarette clamp 1 passes through the first sliding groove 12 of the cigarette fixer 2 and is movable in the axial direction of the device in the first sliding groove 12. The cigarette clamp 1 rotates, thereby driving the cigarette fixer 2 to rotate synchronously. Two trapezoid platforms 13 with sloped surface are provided on one end of the sliding groove. The elastic sheet 9 on the cigarette clamping sheet 8 can slide along the sloped surface and an upper surface of the trapezoid platform 13, so that the cigarette clamping sheet 8 is opened and the clamping of the cigarette clamping sheet 8 to the cigarette butt is relieved. A circular connection hole 14 is provided in the middle of the other end of the cigarette fixer 2. Two positioning arc-shaped convex points 15 are provided on the inner wall of the circular connection hole 14. Two traditional cigarette arc-shaped airflow channels 16 are provided on the outer side of the circular connection hole 14. A portion of the cigarette fixer 2 between a cross section of the traditional cigarette arc-shaped airflow channels 16 and the sliding groove has an inner diameter of 7.5 mm, which is configured to fasten the cigarette and seal the circumferential airflow of the cigarette. The inner diameter of the sliding groove of the cigarette fixer 2 gradually increases from the bottom of one end close to the traditional cigarette arc-shaped airflow through hole to an open end of the cigarette fixer 2, and the maximum inner diameter is 8.0 mm. During the process of the cigarette clamp 1 sliding towards a front end of the device, when the elastic sheet 9 on the cigarette clamping sheet 8 does not touch the sloped surface of the trapezoid platform 13 on the cigarette fixer, the cigarette butt gets detached from the fastening section of the cigarette clamp 1.

As shown in FIG. 7, the support ring 3 is placed on the outer periphery of the cigarette fixer 2. The support ring 3 is preferably made of plastic, and the plastic has a certain elasticity. A plurality of grooves 17 are provided around an inner wall of an end of the support ring 3. The groove 17 is clamped on the boss 18 on the bottom end of the air outlet end housing 5 (see FIG. 4). Two second sliding grooves 19 are provided on the support ring 3. The cigarette clamping sheet 8 on the cigarette clamp 1 passes through the second sliding groove 19 of the support ring 3, and is movable in the axial direction of the device in the second sliding groove 19. When the cigarette clamp 1 rotates, the support ring 3 is driven to rotate synchronously in the peripheral direction.

As shown in FIG. 8, the cigarette butt detruding sliding ring 4 is placed on the outer peripheries of the support ring 3, the spring 7, the cigarette clamp 1 and the metal gasket 6. An annular groove 20 is provided on an inner wall of one end of the cigarette butt detruding sliding ring 4. The annular groove 20 is clamped on the outer periphery of the metal gasket 6. Four positioning grooves 11 are provided on the inner wall of the cigarette butt detruding sliding ring 4. The four positioning protrusion blocks 10 on the cigarette clamper 1 are embedded in the four positioning grooves 11 of the inner wall of the cigarette butt detruding sliding ring 4 (see FIG. 8). When the cigarette butt detruding sliding ring 4 axially slides, the metal gasket 6 and the cigarette clamp 1 are synchronously driven to axially move along one end of the device by compressing the spring 7, and an automatic reset by restoring the spring 7 can be achieved. When the cigarette butt detruding sliding ring 4 rotates in a periphery direction, the cigarette clamp 1, the cigarette fixer 2 and the support ring 3 are driven to rotate synchronously in the periphery direction.

As shown in FIG. 4, two traditional cigarette arc-shaped airflow through holes 21 are provided on a cross section of one end of the air outlet end housing 5. Four positioning arc-shaped concave points 23 are provided on the outer periphery of the boss 22 at the center of the cross section. The positioning arc-shaped concave point 23 is matched with and corresponds to the positioning arc-shaped convex point 15 on the cigarette fixer 2. When positions of the two traditional cigarette arc-shaped airflow channels 16 on the cigarette fixer 2 correspond to (overlap) positions of the two traditional cigarette arc-shaped airflow through holes 21 on the air outlet end housing 5, the traditional cigarette airflow channel is opened. When the positions of the two arc-shaped airflow channels 16 on the cigarette fixer 2 are perpendicular to (not correspond to) the positions of the two traditional cigarette arc-shaped airflow through holes 21 on the air outlet end housing 5, the traditional cigarette airflow channel is closed.

The advantage of the present invention is that after the cigarette filter portion is inserted into the cigarette clamp, the cigarette filter portion is automatically clamped; after the smoking is completed, the cigarette filter portion is automatically released by moving axially through the cigarette butt detruding sliding ring, which facilitates to pull out the cigarette butt smoothly; after that, all the clamping or relieving components are reset, waiting for the smoker to insert next cigarette.

It is obvious that the present invention is not only suitable for automatically detruding the cigarette butt, but can be applied to clamp and relieve any strip, especially the cylindrical strip, which is simple and convenient.

DESCRIPTION OF THE REFERENCES

Figure 1:
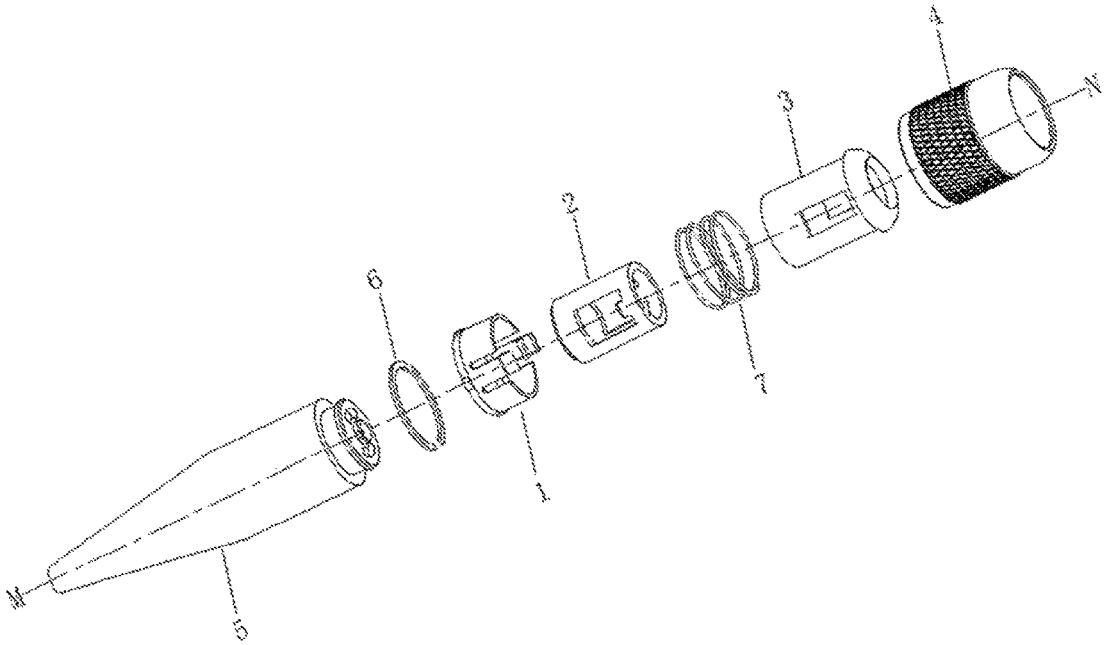
FIG. 1 is an exploded view of a device.
Figure 2:
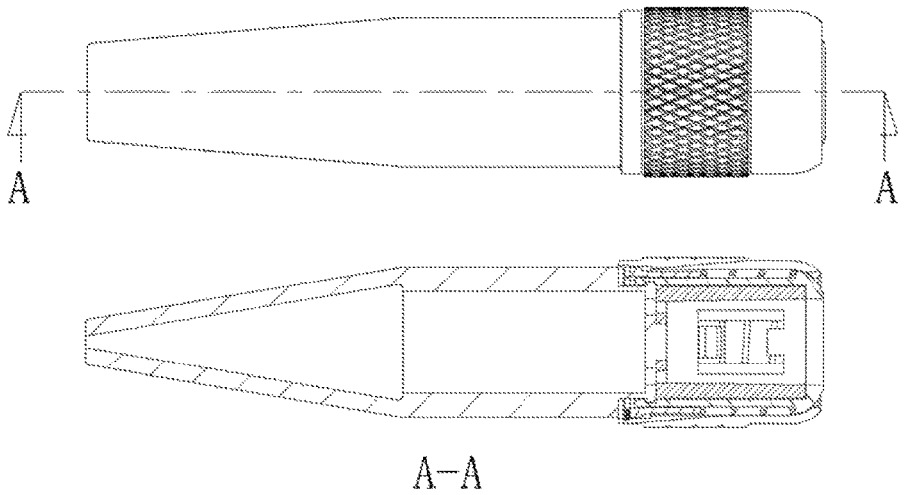
FIG. 2 is an A-A sectional view of a device (the device has a duckbill structure, which is sectioned along a short center plane of a duckbill end to form the A-A sectional view).
Figure 3:
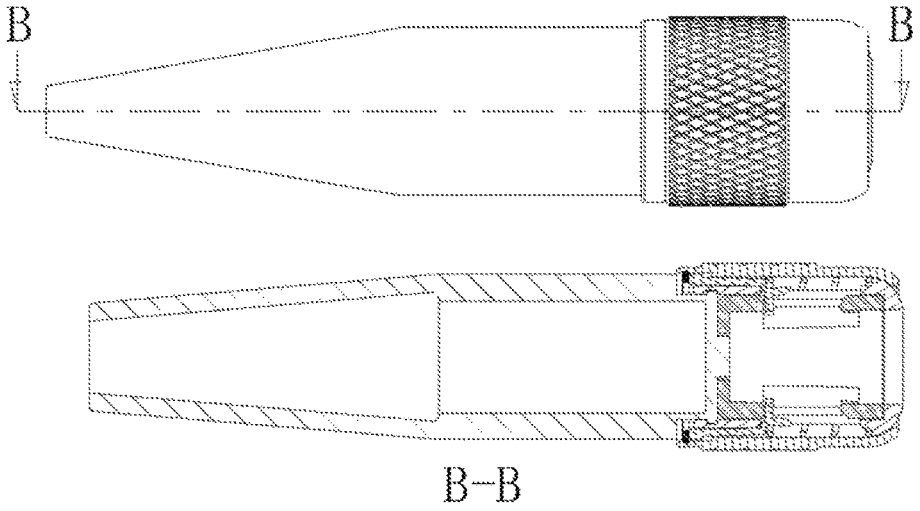
FIG. 3 is a B-B sectional view of a device (the device has a duckbill structure, which is sectioned along a long center plane of a duckbill end to form the B-B sectional view).
Figure 4:
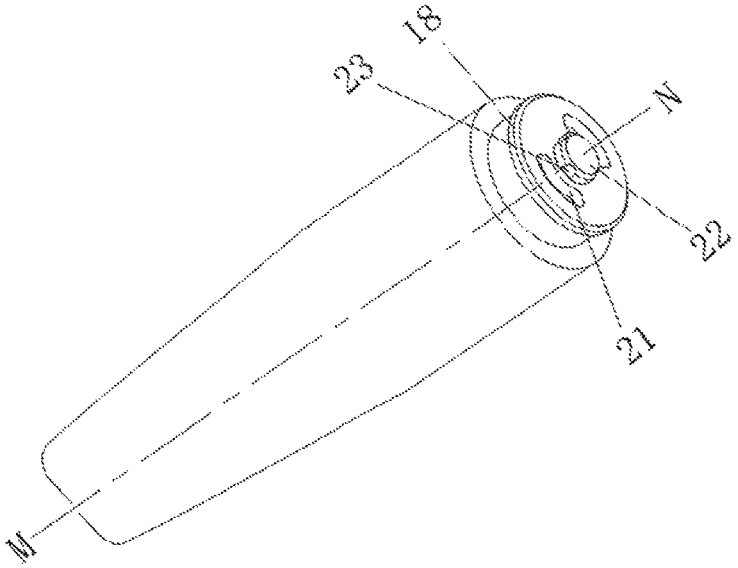
FIG. 4 is a schematic view of an air outlet end housing.

1: cigarette clamp; 2: cigarette fixer; 3: support ring; 4: cigarette butt detruding sliding ring; 5: air outlet end housing; 6: metal gasket; 7: spring; 8: cigarette clamping sheet; 9: elastic sheet; 10: positioning protrusion block; 11: positioning groove; 12: first sliding groove; 13: trapezoid platform with sloped surface; 14: circular connection hole; 15: positioning arc-shaped convex point; 16: arc-shaped airflow channel; 17: groove; 18: first boss; 19: second sliding groove; 20: annular groove; 21: arc-shaped airflow through hole; 22: second boss; 23: positioning arc-shaped concave point; 24: cigarette; 25: cigarette clamping sheet base; 26: flange; 27: U-shaped groove; M-N: central axis.

DETAILED DESCRIPTION OF THE EMBODIMENTS

The technical solutions in the embodiments of the present invention are clearly and completely described hereinafter with reference to the drawings in the embodiments of the present invention. It is obvious that the described embodiments are only some of the embodiments of the present invention instead of all embodiments. All other embodiments obtained by the ordinary person skilled in the art based on the embodiments of the present invention without creative efforts are within the protection scope of the present invention.

The device for automatically detruding the cigarette butt is composed of a cigarette clamp 1, a cigarette fixer 2, a support ring 3, a cigarette butt detruding sliding ring 4, an air outlet end housing 5, a metal gasket 6, and a spring 7.

Figure 6:
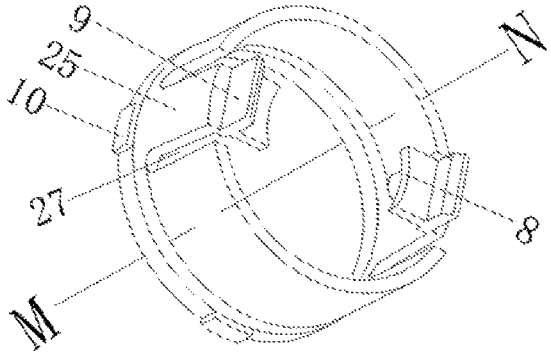
FIG. 6 is a schematic view of a cigarette clamp.
Figure 7:
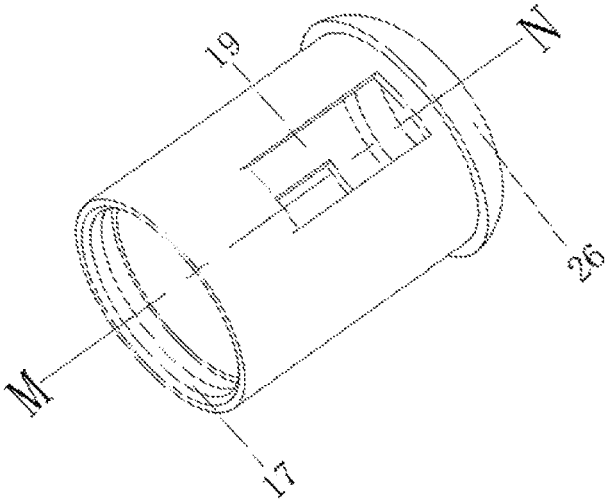
FIG. 7 is a schematic view of a support ring.
Figure 8:
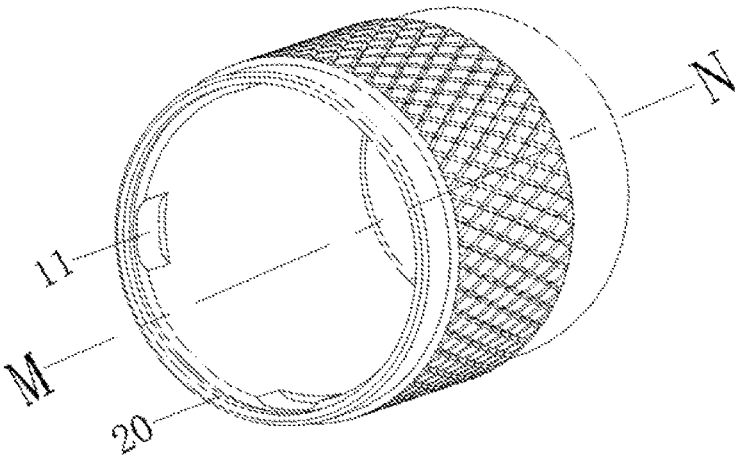
FIG. 8 is a schematic view of a cigarette butt detruding sliding ring.
Figure 9:
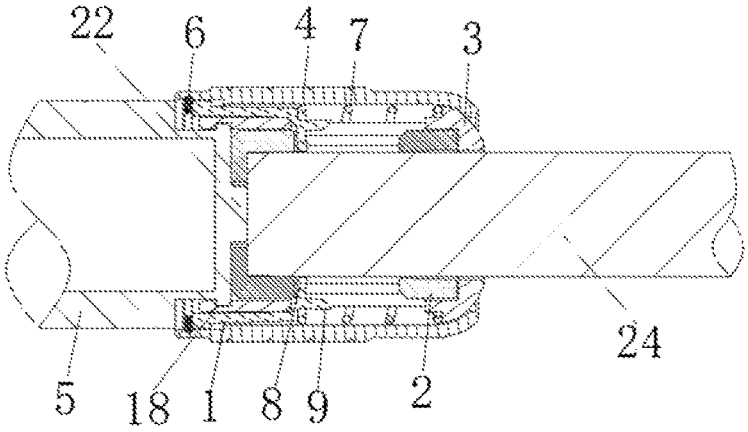
FIG. 9 is a B-B sectional view showing an initial natural state when a cigarette is inserted into a device.
Figure 10:
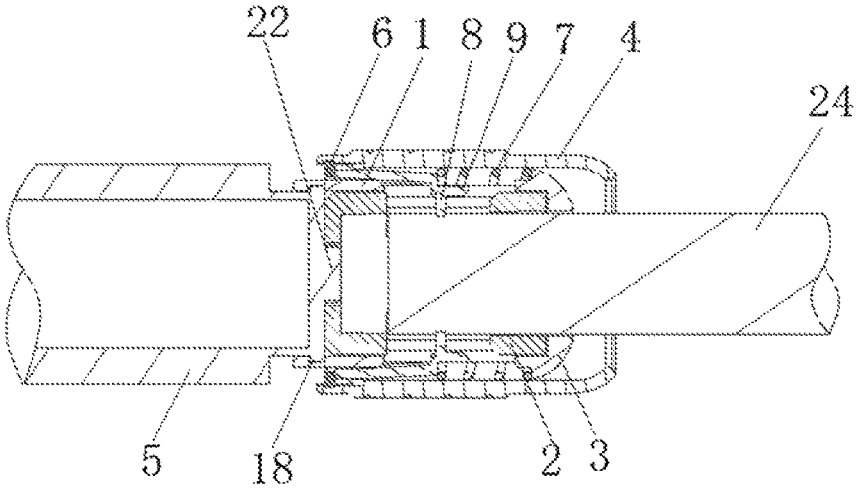
FIG. 10 is a B-B sectional view showing a pulling out state when a cigarette is clamped.
Figure 11:
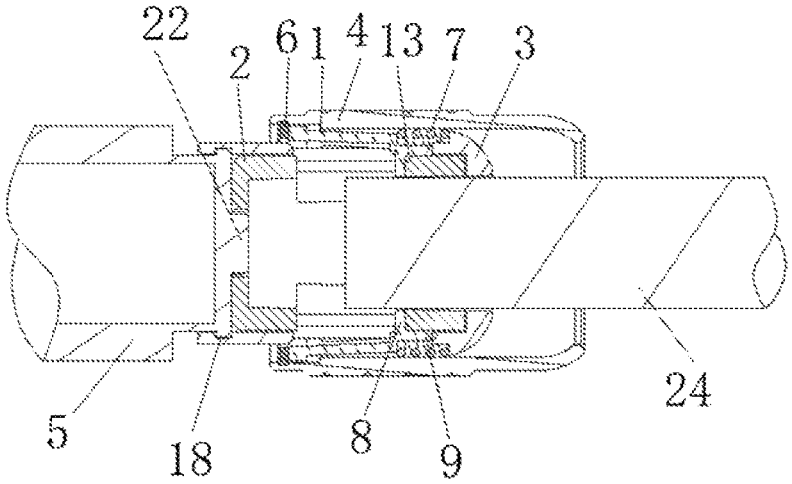
FIG. 11 is a B-B sectional view showing a relieving state when a cigarette is relieved after the cigarette is pulled out.

The cigarette clamp 1 is preferably made of plastic having a certain elasticity. As shown in FIG. 6, an overall structure of the cigarette clamp 1 is funnel-shaped in the longitudinal direction. Two cigarette clamping sheets 8 extending in an inward radial direction are provided on one end of the cigarette clamp 1 to clamp the cigarette. Two elastic sheets 9 in the periphery direction of the device are provided on front ends of the cigarette clamping sheets 8. When the elastic sheet 9 is in contact with the sloped surface of the trapezoid platform 13 on the cigarette fixer 2 and ascends along the sloped surface, the cigarette clamping sheets 8 are opened to relieve the clamping to the cigarette. Four positioning protrusion blocks 10 extending in a radial direction along an exterior of the device are provided on the other end of the cigarette clamp 1. The four positioning protrusion blocks 10 are embedded in the four positioning grooves 11 on an inner wall of the cigarette butt detruding sliding ring 4. When the cigarette butt detruding sliding ring 4 slides, the metal gasket 6 is driven to slide. The metal gasket 6 pushes the cigarette clamp 1 to slide, then the cigarette clamp 1 compresses the spring 7, and the spring 7 is compressed. In the sliding process of the cigarette clamp 1, the two cigarette clamping sheets 8 gradually approach to each other due to the elasticity thereof. When the two cigarette clamping sheets 8 approach to each other for a certain extent, the cigarette butt is clamped tightly and driven to move to the outer side. After the cigarette butt moves for a certain distance, the portion of the cigarette butt filter inserted into the fastening and sealing section of the cigarette fixer 2 is removed (at this time, the elastic sheet 9 on the cigarette clamping sheet 8 has not been in contact with the sloped surface of the trapezoid platform 13 on the cigarette fixer). The cigarette clamp 1 proceeds to move forward, the elastic sheet 9 on the cigarette clamping sheet 8 is in contact with the sloped surface of the trapezoid platform 13 on the cigarette fixer 2, and gradually moves upward along the sloped surface. In this process, the clamping action of the cigarette clamping sheet 8 on the cigarette is gradually relieved until the cigarette clamping sheet 8 is not in contact with the cigarette at all in the end. At this time, the cigarette butt can be smoothly detruded. When the manual force acted on the cigarette butt detruding sliding ring 4 is relieved, the cigarette butt detruding sliding ring 4 and the cigarette clamp 1 are reset automatically through the elasticity of the spring 7. When the cigarette clamp 1 is reset (i.e. when the cigarette clamp 1 is in the initial position of the device in the natural state or the traditional cigarette 24 is inserted into the initial natural state, see FIG. 9), an outer surface of one end of the second sliding groove 19 on the support ring 3 is in contact with the cigarette clamp 1 and pushes the cigarette clamp 1 outwards, so that the cigarette clamp 1 is in a released state during the automatic reset, which facilitates the smooth insertion of the next cigarette. When the cigarette butt detruding sliding ring 4 is rotated, the cigarette butt detruding sliding ring 4 transmits torque to the cigarette clamp 1 through the four positioning protrusion blocks 10 embedded in the groove 20 of the inner wall of the cigarette butt detruding sliding ring 4. Then, the cigarette clamp 1 transmits torque to the side facet of the first sliding groove 12 on the cigarette fixer 2 and the side facet of the second sliding groove 19 on the support ring 3 through the side facet of the cigarette clamping sheet 8 (the cigarette clamping sheet 8 radially passes through the first sliding groove 12 of the cigarette fixer 2 and the second sliding groove 19 of the support ring 3). Thus, when the cigarette butt detruding sliding ring 4 rotates in a peripheral direction, the cigarette clamp 1, the cigarette fixer 2, and the support ring 3 are synchronously driven to rotate in the peripheral direction.

Figure 5:
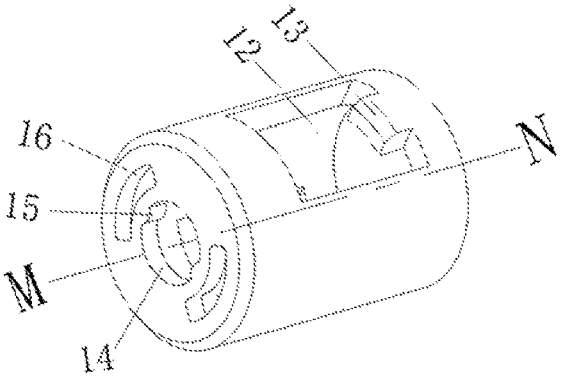
FIG. 5 is a schematic view of a cigarette fixer.

As shown in FIG. 5, the cigarette fixer 2 is preferably made of plastic having a certain elasticity. An overall external structure of the cigarette fixer 2 is cylindrical in shape. Two first sliding grooves 12 are provided on the cigarette fixer 2. The cigarette clamping sheet on the cigarette clamp 1 passes through the first sliding groove 12 and is movable in the axial direction of the device in the first sliding groove 12. Two trapezoid platforms 13 with sloped surface are provided on one end of the first sliding groove 12. The elastic sheet 9 on the cigarette clamping sheet 8 can slide along the sloped surface of the trapezoid platform 13, so that the cigarette clamping sheet 8 is opened to relieve the clamping of the cigarette butt. A circular connection hole 14 is provided in the middle of the other end of the cigarette fixer 2. Two convex points 15 used for positioning are provided on the inner wall of the connection hole 14. The connection hole 14 corresponds and is connected to the boss 22 on a center of a cross section of one end of the air outlet end housing 5. The convex point 15 on the inner wall of the connection hole 14 is correspondingly matched with the positioning arc-shaped concave point 23 on the boss 22 of the center of the cross section of the end of the air outlet end housing, thereby opening and closing the traditional cigarette airflow channel. Two traditional cigarette arc-shaped airflow channels 16 are provided on the outer side of the circular connection hole 14. When the cigarette butt detruding sliding ring 4 is rotated, the inner side peripheries of the four positioning grooves 11 on the inner wall of the cigarette butt detruding sliding ring 4 transmit torque to the cigarette clamp 1 through the four positioning protrusion blocks 10 of the cigarette clamp 1, thereby driving the cigarette clamp 1 to rotate. The cigarette clamp 1 transmits the torque to a side facet of the first sliding groove 12 on the cigarette fixer 2 and a side facet of the second sliding groove 19 on the support ring 3 through a side facet of the cigarette clamping sheet 8 (the cigarette clamping sheet 8 radially passes through the first sliding groove 12 of the cigarette fixer 2 and the second sliding groove 19 of the support ring 3). When the cigarette clamp 1 rotates, the cigarette fixer 2 is driven to rotate. During rotation, when positions of the two traditional cigarette arc-shaped airflow channels 16 on the cigarette fixer 2 correspond to (overlap) positions of the two traditional cigarette arc-shaped airflow through holes 21 on the air outlet end housing 5, the traditional cigarette airflow channel is opened; at this time, the cigarette clamp 1 rotates by 90 degree clockwise or anticlockwise, so that when the positions of the two arc-shaped airflow channels 16 on the cigarette fixer 2 are perpendicular to (not correspond to) the positions of the two traditional cigarette arc-shaped airflow through holes 21 on the air outlet end housing 5, the traditional cigarette airflow channel is closed. A portion of the cigarette fixer 2 between a cross section of the traditional cigarette arc-shaped airflow channels 16 and the first sliding groove 12 has an inner diameter of 7.5 mm, and is a cigarette fastening portion and a cigarette circumferential flow sealing portion, which fastens and fixes the cigarette, and forms a sealing space in the periphery of the cigarette. In this way, air is prevented as much as possible from entering the device through the periphery of the cigarette to ensure that the smoke generated by the combustion of the cigarette enters the device through the inside of the cigarette. The inner diameter of the first sliding groove 12 of the cigarette fixer 2 gradually increases from the bottom of one end closed to the traditional cigarette arc-shaped airflow channels 16 to an open end of the cigarette fixer 2, and the maximum inner diameter is 8.0 mm. During the process of the cigarette clamp 1 sliding towards a front end of the device, before the elastic sheet 9 on the cigarette clamping sheet 8 touches the sloped surface of the trapezoid platform 13 on the cigarette fixer 2, the cigarette butt gets detached from the fastening section of the cigarette clamp 1. When the cigarette clamping sheet 8 clamps the cigarette and continues to slide forward, the inner diameter of the cigarette fixer 2 where the cigarette reaches is gradually larger than the diameter of the cigarette. When the elastic sheet 9 on the cigarette clamping sheet 8 is in contact with the sloped surface of the trapezoid platform 13 on the cigarette fixer 2, and gradually moves upward along the sloped surface, the cigarette clamping sheet 8 gradually relieves the cigarette until the cigarette clamping sheet 8 does not clamp the cigarette at all in the end. At this time, the cigarette butt can automatically slide from the device by means of inclining the end of the device containing the cigarette butt downwards by a certain angle, which realizes convenient, easy and smooth cigarette butt detruding.

In use, the cigarette butt detruding sliding ring 4 is rotated to drive the cigarette clamp 1 and the cigarette fixer 2 to rotate, so that the traditional cigarette arc-shaped airflow channels 16 on one end of the cigarette fixer 2 correspond to (overlap) the traditional cigarette arc-shaped airflow through holes 21 on the air outlet end housing 5, thus opening the traditional cigarette airflow channel of the device. The smoke generated by the combustion of the cigarette inserted at the front end is exported through the traditional cigarette arc-shaped airflow channels 16 on one end of the cigarette fixer 2 and the traditional cigarette arc-shaped airflow through holes 21 on the air outlet end housing 5.

In order to make the smoke generated by the combustion of the cigarette inserted at the front end of the device not exit through the traditional cigarette arc-shaped airflow channels 16 on one end of the cigarette fixer 2 and the traditional cigarette arc-shaped airflow through holes 21 on the air outlet end housing 5, the cigarette butt detruding sliding ring 4 is rotated to drive the cigarette clamp 1 and the cigarette fixer 2 to rotate, so that the traditional cigarette arc-shaped airflow channels 16 on one end of the cigarette fixer 2 are perpendicular to (not correspond to) the traditional cigarette arc-shaped airflow through holes 21 on the air outlet end housing 5, thus closing the traditional cigarette air channel of the device. At this time, the smoke generated by the combustion of the cigarette inserted at the front end of the device cannot exit.

In order to convert the device for automatically detruding the cigarette butt into a device for smoking the electronic cigarette, a power supply may be provided inside the cavity of the air outlet end housing 5, or a non-connecting end of the air outlet end housing 5 is connected to the power supply and then connected to the electronic cigarette atomizer and the suction nozzle to form a hybrid smoking device, which can smoke traditional cigarettes and electronic cigarettes, and automatically detrude the traditional cigarette butts.

The above-mentioned embodiment is merely the preferred embodiment of the present invention, and is not intended to limit the present invention. Any modifications, equivalent substitutions, improvements within the spirit and principle of the present invention should be included within the protection scope of the present invention.

What is claimed is:

1. A device for automatically detruding a cigarette butt, comprising:

a cigarette clamp, wherein an overall structure of the cigarette clamp is cylindrical in shape with two open ends; a plurality of positioning protrusion blocks are provided on a cylinder wall of the cigarette clamp; at least two cigarette clamping sheet bases are provided on the cylinder wall of the cigarette clamp; each of the cigarette clamping sheet bases is an inter-slot cylinder wall formed by opening two U-shaped slots in an axial direction from an end portion of the cylinder wall; a cigarette clamping sheet extending in an inward radial direction is provided on an end portion of each of the cigarette clamping sheet bases, an elastic sheet extending in the axial direction is provided on the cigarette clamping sheet; a space is disposed in the inward radial direction on the elastic sheet to expose the end portion of the cylinder wall on the cigarette clamping sheet bases;

a cigarette fixer, wherein an overall structure of the cigarette fixer is cup-shaped; an inner diameter of the cigarette fixer gradually increases from a bottom of the cigarette fixer to a top of the cigarette fixer; a circular connection hole and an arc-shaped airflow channel are provided on the bottom of the cigarette fixer, wherein a plurality of positioning arc-shaped convex points are arranged on an inner peripheral wall of the circular connection hole; at least two first sliding grooves penetrating through a wall of the cigarette fixer are provided thereon in the wall of the cigarette fixer; a trapezoid platform with a sloped surface extending towards the bottom of the cigarette fixer is provided on an opening end of each first sliding groove;

a support ring, wherein an overall structure of the support ring is cylindrical in shape having two open ends; a groove is provided on an inner wall of a first end of the support ring; a flange is provided on an outer wall of a second end of the support ring; at least two second sliding grooves penetrating through a cylinder wall of the support ring are provided in the cylinder wall of the support ring;

a cigarette butt detruding sliding ring, wherein an overall structure of the cigarette butt detruding sliding ring is cylindrical in shape having two open ends, and an annular groove and a positioning groove are provided on an inner wall of first end of the cigarette butt detruding sliding ring; a shape of the positioning groove is matched with a shape of each positioning protrusion block on the cigarette clamp;

an air outlet end housing, wherein an overall structure of the air outlet end housing is in a hollow duckbill-shaped cylinder-like shape; a first boss is provided on an end surface of one end of the air outlet end housing; an arc-shaped airflow through hole and a second boss are provided on an end surface of the first boss; a plurality of positioning arc-shaped concave points are provided on a peripheral wall of the second boss; a number and a shape of the positioning arc-shaped concave points are matched with a number and a shape of the positioning arc-shaped convex points on the cigarette fixer a metal gasket, wherein an overall structure of the metal gasket is a notched annular elastic member; and a spring;

wherein, the circular connection hole in the bottom of the cigarette fixer is sleeved on the second boss of the air outlet end housing, the circular connection hole and the second boss are connected to each other through a cooperation of the positioning arc-shaped convex point with the positioning arc-shaped concave point, the arc-shaped airflow channel and the arc-shaped airflow through hole butt each other after realizing a connection between the circular connection hole and the second boss;

the support ring is sleeved on an outer periphery of the cigarette fixer, the second sliding groove coincides with the first sliding groove, the groove of the support ring is sleeved on an outer periphery of the first boss of the air outlet end housing;

the cigarette clamp is sleeved on an outer periphery of the support ring, the cigarette clamping sheet base, the cigarette clamping sheet and the elastic sheet are located inside the second sliding groove and the first sliding groove, the elastic sheet and the trapezoid platform with the sloped surface of the cigarette fixer are in a straight direction;

the cigarette butt detruding sliding ring is sleeved on an outer periphery of the metal gasket and an outer periphery the flange of the support ring, the annular groove of a first end of the cigarette butt detruding sliding ring is connected to the metal gasket through clamping and sleeving the annular groove of the inner wall of the first end of the cigarette butt detruding sliding ring on the outer periphery of the metal gasket in a pre-stressed state, the cigarette butt detruding sliding ring is connected to the flange of the support ring through sleeving an inner wall of a second end of the cigarette butt detruding sliding ring on the outer periphery of the flange of the support ring, the positioning groove is matched with each positioning protrusion block; and the spring is sleeved on an outer periphery of a cylindrical section of the support ring, a first end of the spring abuts against the end portion of the cylinder wall of the cigarette clamp and is sleeved on an outer periphery of the elastic sheet, a second end of the spring abuts against the flange of the support ring.

2. The device for automatically detruding the cigarette butt according to claim 1, wherein the metal gasket contacts the end portion on the cylinder wall of the cigarette clamp away from the elastic sheet in the axial direction.

3. The device for automatically detruding the cigarette butt according to claim 1, wherein an outer diameter of the cigarette fixer is constant, while a wall thickness of the cigarette fixer gradually decreases from a bottom end of the cigarette fixer to a top end of the cigarette fixer, thereby achieving an increase of the inner diameter of the cigarette fixer from the bottom end of the cigarette fixer to the top end of the cigarette fixer.

4. The device for automatically detruding the cigarette butt according to claim 1, wherein a side facet of the cigarette clamping sheet on the cigarette clamp is in contact with a side facet of the first sliding grooves on the cigarette fixer and a side facet of the second sliding grooves on the support ring when rotated, so as to transmit torque.

5. The device for automatically detruding the cigarette butt according to claim 1, wherein the cigarette clamp, the cigarette fixer and the support ring are made of an elastic material.

* * * * *